US008754387B2

(12) United States Patent
Botha

(10) Patent No.: US 8,754,387 B2
(45) Date of Patent: Jun. 17, 2014

(54) HANDLING OF RADIOACTIVE MATERIALS

(75) Inventor: Johannes Samuel Frederik Botha, Pretoria (ZA)

(73) Assignee: The South African Nuclear Energy Corporation Limited, District Brits (ZA)

( * ) Notice: Subject to any disclaimer, the term of this patent is extended or adjusted under 35 U.S.C. 154(b) by 16 days.

(21) Appl. No.: 13/202,192

(22) PCT Filed: Feb. 11, 2010

(86) PCT No.: PCT/IB2010/050619

§ 371 (c)(1),
(2), (4) Date: Aug. 18, 2011

(87) PCT Pub. No.: WO2010/095079

PCT Pub. Date: Aug. 26, 2010

(65) Prior Publication Data

US 2011/0301400 A1 Dec. 8, 2011

(30) Foreign Application Priority Data

Feb. 20, 2009 (ZA) ..... 2009/01230

(51) Int. Cl.
*G21K 5/04* (2006.01)
*G21F 5/14* (2006.01)
*G21F 7/06* (2006.01)

(52) U.S. Cl.
CPC ... *G21F 5/14* (2013.01); *G21F 7/06* (2013.01)
USPC ..... 250/505.1; 250/506.1; 250/507.1

(58) Field of Classification Search
CPC ..... G21F 3/00; G21F 5/0005; G21F 5/015; G21F 5/06; G21F 5/14; G21F 7/00; G21F 7/06; G21F 7/061; G21F 7/063; G21F 7/065
USPC ..... 250/505.1, 506.1, 507.1, 515.1
See application file for complete search history.

(56) References Cited

U.S. PATENT DOCUMENTS

| | | | | |
|---|---|---|---|---|
| 3,644,737 | A * | 2/1972 | Fedi et al. | 250/506.1 |
| 6,843,541 | B1 | 1/2005 | Mills et al. | |
| 2005/0042710 | A1 | 2/2005 | Oshima et al. | |
| 2009/0272920 | A1 * | 11/2009 | Hannah et al. | 250/507.1 |

FOREIGN PATENT DOCUMENTS

| | | | |
|---|---|---|---|
| DE | 10155121 | A1 | 6/2003 |
| EP | 0505269 | A1 | 9/1992 |
| GB | 947074 | A | 1/1964 |
| GB | 1265940 | A | 3/1972 |

OTHER PUBLICATIONS

International Search Report and Written Opinion, International Patent Application PCT/IB2010/050619, dated Sep. 27, 2010, 17 pages.
International Preliminary Report on Patentability, International Patent Application PCT/IB2010/050619, dated May 10, 2011, 10 pages.

* cited by examiner

*Primary Examiner* — Nicole Ippolito
(74) *Attorney, Agent, or Firm* — Fitch Even Tabin & Flannery LLP

(57) ABSTRACT

A radioactive material handling assembly (10) includes an outer housing (12) and an inner cell (14). The inner cell defines a radioactive material containment/handling chamber (16) and is removably mountable inside the outer housing. Handling means is operable from outside the inner cell to handle radioactive materials located in the containment/handling chamber. At least one of the outer housing and the inner cell is predominantly of a shielding material which is opaque to radioactivity.

23 Claims, 5 Drawing Sheets

HANDLING OF RADIOACTIVE MATERIALS

CROSS REFERENCE TO RELATED APPLICATIONS

This application is a national phase application of International Application No. PCT/IB2010/050619, filed Feb. 11, 2010, claiming priority to South African Application No. 2009/01230, filed Feb. 20, 2009, both of which are incorporated by reference herein in their entirety.

THIS INVENTION relates to the handling of radioactive materials. More particularly, the invention relates to a radioactive material handling assembly and to a method of operating such a radioactive material handling assembly.

Shielded installations are typically used in applications for safe handling, e.g. examination and/or treatment, of radioactive materials. Such installations are typically constructed of a shielding material which is opaque to radioactivity, and define a holding or handling chamber, in which a radioactive material can be contained and examined and/or treated. A disadvantage of such installations is that once one type of radioactive material has been introduced into the handling chamber, the chamber, and accordingly the installation, must be de-contaminated before it can be used for a different radioactive material, thereby to prevent cross-contamination between the different radioactive materials. Apart from thus generating large volumes of radioactive waste, a further, related disadvantage is that such installation decontamination operations are typically very time-consuming, resulting in unacceptably excessive time requirements for conducting successive operations involving a variety of radioactive materials, such as routine tests, experiments, or small scale radiochemical production operations. Alternatively, a plurality of such installations is required, inevitably leading to multiplication of facilities and infrastructure. Conducting multiple operations in a short time, therefore, will typically be beyond the capability of most facilities. The Applicant believes that the present invention will find application particularly in alleviating the abovementioned disadvantages.

Thus, according to a first aspect of the invention, there is provided a radioactive material handling assembly, which includes

- an outer housing;
- an inner cell which defines a radioactive material containment/handling chamber and which is removably mountable inside the outer housing; and
  - handling means operable from outside the inner cell to handle radioactive materials located in the containment/handling chamber, with at least one of the outer housing and the inner cell being predominantly of a shielding material which is opaque to radioactivity.

Unless otherwise indicated, by "handle" or "handling" is meant handling and/or treatment of radioactive materials located inside the inner cell, and by "handling means" is correspondingly meant means for carrying out such handling. Similarly, "containment/handling chamber" refers to the chamber defined by the inner cell in which containment of radioactive materials and such handling of radioactive material is carried out, when the inner cell is mounted inside the outer housing.

By "predominantly" is meant that all the major components, such as the walls, etc of said at least one of the outer housing and the inner cell are of the shielding material which is opaque to radioactivity. Preferably, the outer housing is predominantly of shielding material which is opaque to radioactivity. Thus, the major components of the outer housing, such as its walls, etc may be of lead.

The assembly may include a plurality of inner cells which are individually removably mountable inside the outer housing. Typically, the assembly includes an inner cell for each radioactive material which is to be handled in the assembly.

The outer housing and the inner cell may thus have complementary shapes, typically when viewed in horizontal section, such that the inner cell can be snugly received and mounted within the outer housing.

The handling means comprise manipulating means inside the containment/handling chamber, which is hereinafter also referred to simply as "the handling chamber". The manipulating means is thus arranged to carry out manipulation operations inside the handling chamber. The manipulation means may comprise a pair of tongs or the like. The handling means may include attachment means connecting the manipulating means to a wall of the inner cell. The attachment means may thus be configured to enable movement of the manipulating means while connected to walls of the inner cell. Still more particularly, the attachment means may be flexible attachment means, such as flexible boots, which are sealably mounted to walls of the inner cell such that containment integrity of the inner cell is maintained. Movement of the handling means within the handling chamber is then restricted by the extent to which the flexible attachment means are capable of flexing or deforming.

Each handling means may be removably connected to its associated attachment means, thereby enabling the use of a variety of handling means in association with one attachment means.

The inner cell, and accordingly the handling chamber, may be provided with storage space for storing additional handling means which are removably connectable to the attachment means.

The assembly may include control means for the handling means. The control means, in use, is operable to control operation of the handling means from a position remote from the handling chamber, preferably from a position remote from the inner cell, when the inner cell is mounted in the outer housing. The handling means and associated control means are provided separately respectively in the inner cell and on the outer housing, the control means being operatively connectable to its associated handling means when the inner cell is mounted in the outer housing. Preferably, complementary pairs of handling means and control means are provided in corresponding positions in operationally adjacent walls of the inner cell and outer housing, i.e. walls which are adjacent when the inner cell is mounted in the outer housing.

Each control means may comprise a control rod, one end portion of the control rod being connected or connectable to the handling means and the other end portion of the control rod extending beyond the confines of the outer housing and being provided with a user control interface, such as a pistol grip. The control rod may be pivotally mounted in a wall of the outer housing by means of a pivotal mounting, thereby to direct pivotal movement of the handling means when connected thereto. It will be appreciated that the mountings which connect the control means to the outer housing may also be of radiation opaque material. Typically, the mountings may be lead ball-sockets having a radiation shielding power of at least 100 mm lead. Control rods of various lengths may be employed with each handling means, thereby to provide a variety of operating ranges of the handling means in the handling chamber. It will be appreciated that the length of a control rod thus also restricts the extent to which an associated handling means thereof is displaceable inside the handling chamber, the operating range of the handling means thus being determined by the deformability of its associated connecting member and the length of its associated control rod.

The assembly may include at least two of the handling means. The handling means may then be mounted to the inner cell such that they are angularly spaced from each other, when seen in plan view. Typically, they may, in plan view, be at a right angle to each other. More particularly, the assembly may include at least two handling means which are provided at angularly spaced positions about a vertical line of intersection between tangents to a connection point of each handling means to a wall of the inner cell, said angular spacing typically being 90°. Preferably, the assembly may include two handling means which are each provided in a different wall of the inner cell, the walls being angularly spaced from each other about a vertical line of intersection between the walls, e.g. at a right angle to each other, if the walls are adjacent each other, or about a vertical line of intersection between projections of the walls if the walls are not adjacent each other. It will be appreciated that connection points of the handling means in the walls are then, effectively, also spaced at a right angle from each other about said line of intersection which is effectively also a line of intersection between tangents to the connection points of the handling means in the walls.

It is to be appreciated that, in the embodiment as hereinbefore described, the control means associated with each of the angularly spaced handling means are also angularly spaced from each other in the same fashion as their associated handling means and are thus located at angularly spaced positions in walls of the outer housing corresponding to positions of the angularly spaced handling means.

The assembly may include viewing means in the outer housing and the inner cell, for visual inspection of radioactive materials contained in and being handled inside the handling chamber when the inner cell is mounted inside the outer housing. The viewing means may be in the form of at least one window in a wall of each of the inner cell and the outer housing, the windows providing a line of sight from a position external to the assembly, to the handling chamber when the inner cell is mounted inside the outer housing.

At least one of the windows may be of radiation opaque material. The radiation shielding window may have a radiation shielding power equivalent to at least 75 mm lead. Preferably, the radiation shielding window has a radiation shielding power equivalent to about 100 mm lead. The inner cell window may then typically be of polycarbonate.

When the assembly includes angularly spaced handling means and associated angularly spaced control means as hereinbefore described, a window or other viewing means may be provided in a wall of the outer housing, between the angularly spaced control means, which window then provides a line of sight into the handling chamber through the inner cell window when the inner cell is mounted inside the outer housing. If the angularly spaced handling means are provided in angularly spaced walls as hereinbefore described, the walls may be connected by a connecting wall in which the window is provided. The connecting wall may be obliquely oriented relative to said angularly spaced walls. It will be appreciated that, in such an embodiment, the angularly spaced walls are then not adjacent each other and are accordingly angularly spaced about a vertical line of intersection between projections thereof.

It is envisaged that, when the assembly includes such angularly spaced handling means, and associated angularly spaced control means, and a window is provided in a wall of the outer housing between the angularly spaced control means, an operator of the assembly will, in use, operate the angularly spaced handling means by means of the angularly spaced control means from a position between the control means adjacent the window provided in the oblique wall, between the angularly spaced control means.

The handling means, or at least two other handling means, and their associated control means, may be positioned at different levels in the inner cell and outer housing. Thus, the handling means and associated control means are vertically spaced from each other. In a preferred embodiment of the invention, the angularly spaced handling means and their associated angularly spaced control means are vertically spaced from each other.

The inner cell may be provided with handling chamber access means for introducing materials, particularly non-radiating materials, into, and withdrawing such materials out of, the handling chamber.

Typically, the handling chamber access means comprises a double door assembly, i.e. an inner and an outer door assembly, such that the integrity of the handling chamber is not compromised during the introduction of materials into, or withdrawal of materials out of, the handling chamber. More particularly the inner cell may be provided with at least one Double Porte de Transfert Etanche™ ("DPTE") port. Typically, the inner cell is provided with two DPTE ports of different sizes. In a preferred embodiment of the invention, the inner cell is provided with at least one 105-DPTE port and at least one 270-DPTE port.

Inner doors of the DPTE ports may be operated or actuated by the handling means. Typically, a DPTE port may be located within the operating range of at least one handling means in the inner cell such that an inner door of the DPTE port can be operated by the handling means in which operating range it is located. In a preferred embodiment of the invention, at least one DPTE port is provided in direct, i.e. perpendicular, alignment with at least one handling means. Thus, at least one DPTE port may be provided in a wall of the inner cell opposite to the wall of the inner cell in which the handling means associated therewith is provided.

In use, when the inner cell is provided with a DPTE port and a door of the DPTE port is to be opened, radioactive materials will preferably be positioned in the handling chamber such that passage of a radiation beam through the door is avoided. In other words, in use, before a DPTE door is opened, radioactive materials are typically positioned inside the handling chamber such that they are not in direct alignment with a DPTE port.

The inner cell may also be provided with a bottom loading port for loading materials, particularly radioactive materials, into and out of the handling chamber through the bottom of the cell, and closing means which closes and seals the bottom loading port from the inside of the handling chamber. The loading port may be configured to receive or dock containers, or pots as they are known in the art of the invention, containing radioactive material which is to be loaded into the handling chamber. The closing means may be in the form of a lid. The lid is thus operable only from within the handling chamber. The lid may thus be operated by the handling means.

The outer housing may be provided with bottom loading port access means. The bottom loading port access means may be associated with and provide access to the bottom loading port of the inner cell from outside the assembly, when the inner cell is mounted in the outer housing. The bottom loading port access means may comprise an opening in the bottom of the outer housing at an operationally corresponding location to the bottom loading port of the inner cell and may be provided with a removable cover in the form of a shielding slot or stopper, which will hereinafter be referred to as a "key", which is openable or removable from outside the outer housing. The key may be connectable to the lid of the bottom loading port when the inner cell is mounted inside the outer housing and may thus lock the lid of the bottom loading port in a closed position and prevent opening thereof when connected thereto, thereby preventing inadvertent opening of the bottom loading port lid from the inside of the inner cell when no container or pot is received in or docked against the bottom loading port. Typically, the key may engage or slot into the bottom loading port lid by means of a bayonet fitting. The key may be of a radiation opaque or shielding material, e.g. which has a radiation shielding power equivalent to 50 mm lead. Thus, the key provides the required radiation shielding for the bottom loading port in the normal closed state.

To provide further radiation shielding, a section of radiation shielding material, e.g. a lead ring, may be incorporated into the trolley. The ring may provide further radiation shielding of the bottom loading port when the key is disconnected from the lid.

To facilitate safe transport of containers with radioactive source or sample materials into and from the inner cell of the radioactive material handling assembly, a container loading assembly including container displacement means for docking containers against the bottom loading port through the bottom loading port access means may be provided on the outer housing. The container displacement means may be operable to displace a container or pot mounted thereon from outside the radioactive material handling assembly, through the bottom loading port access means of the outer housing towards the bottom loading port of the inner cell. Typically, the container displacement means is configured to support a container mounted thereon and also to displace the container mounted thereon into axial alignment with the loading port access means. The container displacement means may further be configured to displace the container in axial alignment with the loading port access means, i.e. vertically. It will be appreciated that, as mentioned hereinbefore, the container may also be referred to as a "pot", as is common in the field of the invention.

The container displacement means may include a trolley, which is supported by a rail track which is suspended from the outer housing. The trolley is typically configured to receive thereon, in addition to the container, the key of the bottom loading port access means when the key is removed from the bottom loading port access means. In one embodiment, the trolley may be provided with a key receptacle thereon, which key receptacle receives the key when it has been removed from the bottom loading port access means. Thus, in use, when the key is being removed, the key receptacle is positioned in axial alignment with the bottom loading port and loading port access means, thereby to receive the key once it is removed. The trolley may also be configured such that the container can only be moved into a position in axial alignment with the loading port when the key has been removed from the bottom loading port access means and has been stowed in the receptacle. Typically, when the key is in a closed or locked position, the spatial relationship between the trolley and key is such that the key prevents horizontal movement of the trolley, thus locking it in position, e.g. by partially extending into the recess defined by the key receptacle.

The loading assembly means may include hoisting means for hoisting a container towards the bottom loading port in a closed condition. The loading assembly may therefore be provided with hoisting means. The hoisting means may be in the form of a mechanical lever or pulley system, or an axial drive means such as a hydraulic piston. The loading assembly may further be configured to open the lid of the container when, and only when, it is positioned at a predetermined height in close proximity to, but not yet docked against the bottom loading port, such that radiation exposure is prevented and handling chamber integrity is maintained throughout the hoisting and docking operation.

Opening the container may be effected by means of a horizontal sliding plate, which is mounted on the loading assembly transversely to a hoisting direction and at the above-mentioned predetermined height. The sliding plate typically has an opening and circumferential clamping means of larger diameter than the lid of the container. Thus, in use, the lid is clamped to the sliding plate, the container is slightly lowered and the lid is removed from above the container so that the open container can then be raised to its docking position against the bottom loading port. Typically, the bottom loading port lid is then opened from the inside of the cell to provide access to the radiation source or sample material inside the container.

The loading assembly may be configured to dock containers of different diameter to the bottom loading port. In one embodiment, this is effected by having mounted to the hoisting means, for each container of a particular diameter, a matching outer spacer ring or sleeve, preferably of radiation opaque material, for receiving the container, with the outer spacer, ring or sleeve having a fixed outer diameter and shaped to match a carriage of the hoisting means as well as the bottom loading port opening. The ring or sleeve thus fits snugly around the container such that, when the lid of the container has been removed, the container and spacer ring docks radiation leak free to the bottom loader port of the inner cell.

The inner cell may also be provided with at least one ventilation inlet to the handling chamber and at least one exhaust outlet from the handling chamber. The ventilation inlet and the exhaust outlet may be provided, respectively, with inlet and outlet filters. In a preferred embodiment of the invention, the inlet and outlet are each provided with a filter arrangement comprising two filter elements, one element positioned inside the inner cell and another element provided outside the inner cell, in the space between the inner cell and the outer housing. It is envisaged that, by such an arrangement, replacement and service of the filters as well as interchanging the inner cells can be effected without compromising the integrity of the handling chamber. Preferably, the filter arrangements are positioned such that each inner filter element is in line with, or within operating range of, at least one handling means so that service and replacement of the inner filter element in each filter arrangement can be effected from inside the handling chamber by means of the handling means, without compromising handling chamber integrity.

The inlet filter arrangement on the inner cell may have a corresponding service access means in the form of an opening in the outer housing, which opening may be shielded by a radiation opaque plug or stopper, thereby to prevent radiation emission through the inlet and its associated filter arrangement. The stopper may be removable, thereby to allow replacement of the outer inlet filter element through said access means.

The exhaust outlet and outlet filter arrangement may also have a service access means for replacing the outer exhaust filter element, which may be shielded by a lead plug or stopper, generally in similar fashion to the plug or stopper on the inlet, thereby to prevent radiation emission through the outlet. The outer filter element of the exhaust outlet filter arrangement may be connected by means of an exhaust line to a ventilation system of a laboratory or other site for accommodating the radioactive material handling assembly. The exhaust line may typically pass through the service access means plug such that radiation is prevented from leaking through the plug from the handling chamber through the exhaust outlet. In a preferred embodiment this may be achieved by guiding the exhaust line through the plug along a specially designed void, typically in the form of a maze or labyrinth channel, such that it will allow easy passage of the exhaust line, but prevent radiation leakage through the plug.

In use, a low pressure is created inside the handling chamber due to the outflow of air through the exhaust outlet into the ventilation system. Air is thus drawn into the inner cell through the ventilation from the surrounding air outside the inner cell within the outer housing and thus, as a consequence, also from outside the outer housing, thereby creating a net inflow of uncontaminated air from outside the outer housing into the inner cell.

As hereinbefore described, the outer housing may have walls of radiation opaque or shielding material, such as lead. Preferably, the outer housing comprises lead wall, floor and roof panels, comprising interlocking lead bricks or solid lead slabs, which are supported by a high integrity support frame.

The inner cell may have walls of stainless steel.

The radiation shielding power of the outer housing may, for walls thereof, be equivalent to at least 50 mm lead.

At intersections between adjacent walls of the housing, where a danger of radiation emission exists, in that a radiation beam may pass through openings and/or sections of low radiation shielding of the intersection, commonly referred to in the art of the invention as a "beam path", additional radiation shielding may be provided.

The outer housing may also be provided with a carriage on which the inner cell may be transported into or out of the housing. Inside the outer housing, the cell may be stabilized on the carriage by securing the cell to stabilization mountings inside the outer housing.

The outer housing may also be provided with access means to an interior thereof. More particularly, the outer housing may be provided with at least one primary or main door through which the inner cell is inserted into the outer housing. In a preferred embodiment of the invention, the door of the outer housing is a slidably, vertically displaceable trapdoor, operation of which may be controlled by a counterweight arrangement.

The outer housing may also be provided with secondary doors which provide access to the DPTE ports in the inner cell when the cell is mounted inside the outer housing. The secondary doors are thus preferably arranged in positions in the outer housing which correspond to the positions of DPTE ports in the inner cell when the inner cell is mounted in the outer housing. In a preferred embodiment of the invention, at least one DPTE port, typically a 270-DPTE port, is provided in a wall of the inner cell which is operationally adjacent the main door of the outer housing, the main door thus providing access to such a DPTE port.

The radiation shielding power of doors of the outer housing may be equivalent to at least 50 mm lead.

The inner cell may be provided with connection means for linking additional services, in addition to the handling means, such as electricity, gas, vacuum, water and compressed air to the handling chamber. Such connection means are preferably configured such that linkage of additional services to the handling chamber does not compromise the integrity thereof at any time during connection or disconnection. The connection means for connection of the abovementioned services are preferably provided in one wall, which is preferably a wall in which a DPTE port is provided. In an embodiment wherein the connection means are thus provided, the DPTE port is preferably a 270-DPTE port and the wall is preferably a wall of the inner cell which is operationally adjacent a main door of the outer housing.

The outer housing may be provided with a chamber for housing radiation detection and/or radiation monitoring equipment. The chamber may be of radiation shielding material having a radiation shielding power equivalent to 50 mm lead. The inner cell may also be provided with radiation detection and/or monitoring equipment.

The outer housing may be provided with inner cell lighting means, the lighting means providing light to the inner cell through the inner cell window. The lighting means may be in the form of electrical lights which are provided in light sockets each of which is mounted on a base of radiation shielding material having a radiation shielding power equivalent to 50 mm lead, in the form of a plug or slot which fits from the outside through the roof of the outer housing in a radiation leakage free manner.

The assembly may have warning means, such as one or more alarms. At least one alarm may operate in conjunction with the radiation detection and/or monitoring equipment and may be configured to indicate an unacceptable level of radiation emission from the assembly. Another alarm may operate in conjunction with the ventilation system to indicate a failure or insufficient flow of ventilation air.

According to a second aspect of the invention, there is provided a method of operating a radioactive material handling assembly according to the first aspect of the invention, to handle radioactive materials therein, the method including inserting an inner cell into the outer housing of the assembly;

handling a radioactive material inside the containment/handling chamber of the inner cell from a position outside the outer housing; and removing the inner cell from the outer housing.

The method may include inserting a second inner cell into the outer housing after removal of the initial or first inner cell from the outer housing and handling a second different radioactive material inside the containment/handling chamber of the second inner cell, the second radioactive material being different to the initial or first radioactive material, e.g. having different radiation emission properties to that of the first radioactive material.

The method may still further include servicing third and further radioactive materials, different to the first and second radioactive materials, respectively in third and further inner cells which are in turn loaded or inserted into the outer housing.

In a preferred embodiment of the invention, the method may include handling similar radioactive materials in the assembly in the same inner cell of the assembly and handling different radioactive materials in the assembly each in a separate inner cell of the assembly.

The method may include loading a radioactive material into its associated inner cell after the inner cell has been inserted into the outer housing. Alternatively, the method may include loading the radioactive material into its associated inner cell before the inner cell has been inserted into the outer housing.

The method may also include removing a radioactive material from its associated inner cell before the inner cell is removed from the outer housing. Alternatively, the method may include removing the radioactive material from its associated inner cell after the inner cell has been removed from the outer housing.

The loading into and/or removing out of the inner cell of radioactive material after the inner cell has been removed from the outer housing is particularly advantageous when such materials are "soft" radiators, i.e. emitting only low intensity radiation, which is sufficiently contained by the shielding power of the inner cell itself.

The method may further include decontaminating the outer housing after an inner cell has been removed therefrom and before another inner cell is inserted therein.

The method may also include decontaminating the inner cell, after removal of the inner cell from the outer housing.

The method may further include sealing the inner cell before or after removal thereof from the outer housing thereby to maintain its integrity.

The invention will now be described in more detail, with reference to the following diagrammatic drawings.

Figure 2:
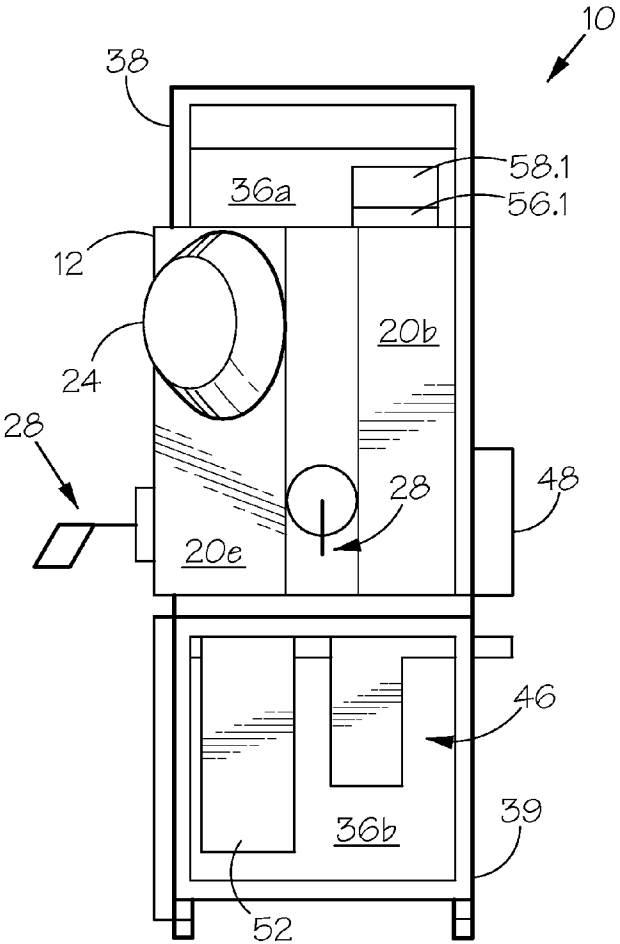
FIG. 2 shows one side view of the handling assembly of FIG. 1.
Figure 1:
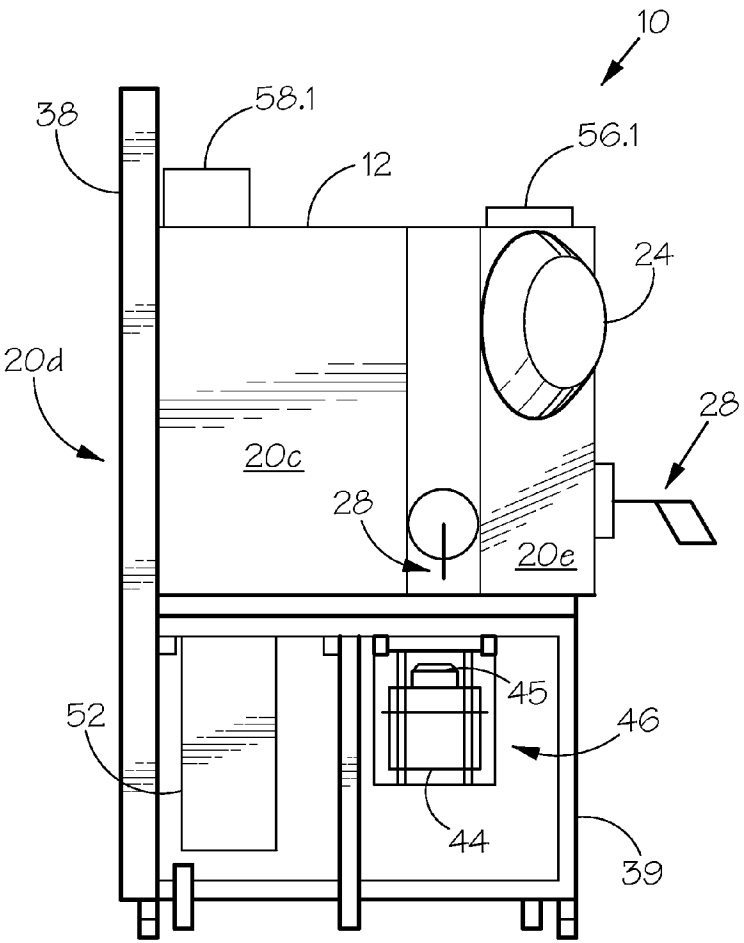
FIG. 1 shows a front view of an assembled radioactive material handling assembly in accordance with the invention.

In the drawings, reference numeral 10 generally indicates a radioactive material handling assembly in accordance with the invention.

Figure 4:
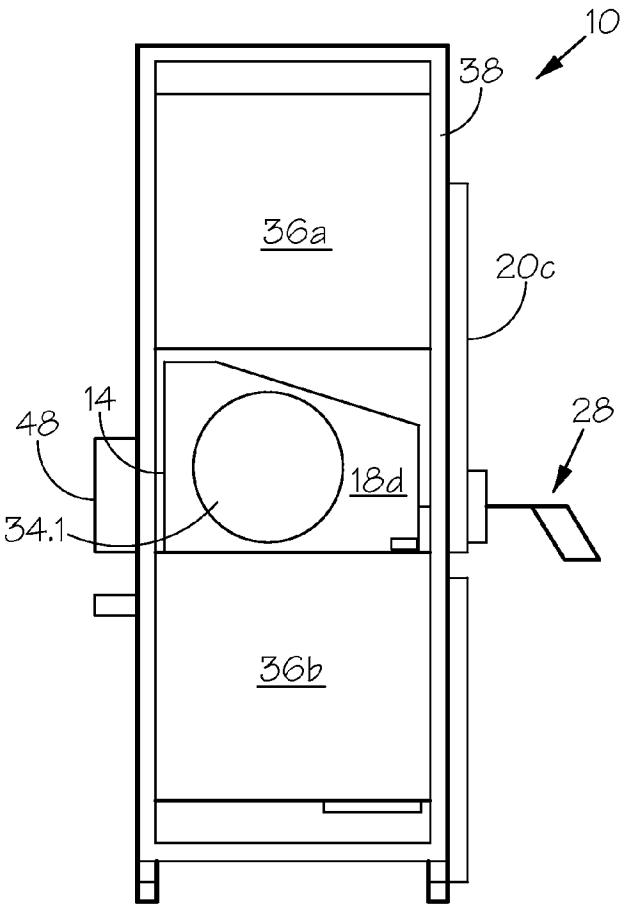
FIG. 4 shows another side view of the handling assembly of FIGS. 1 to 3.
Figure 3:
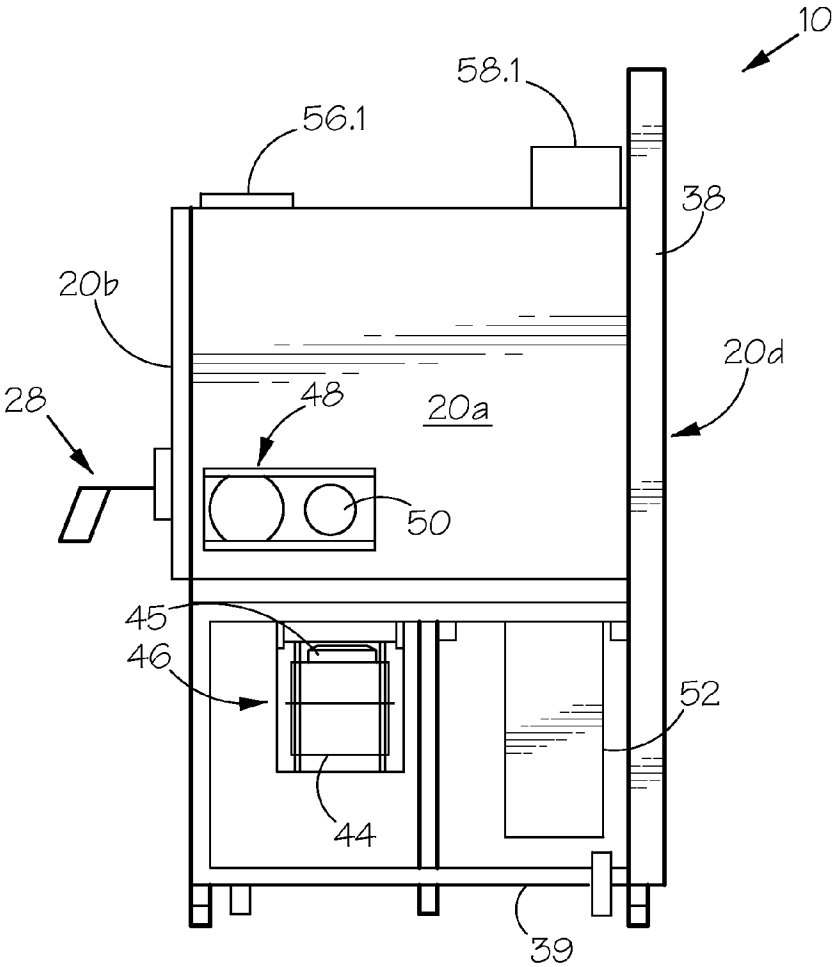
FIG. 3 shows a rear view of the handling assembly of FIGS. 1 and 2.

The assembly includes an outer housing 12 and an inner cell 14 (which is shown in some detail in FIGS. 4, 5 and 6), the inner cell 14 being removably mounted inside the outer housing 12 on tracks (not shown), which facilitate insertion of the inner cell 14 into the outer housing 12. The inner cell 14 is stabilized on the tracks inside the outer housing 12 by connection to anchoring or stabilization mountings (not shown) provided inside the outer housing 12.

The inner cell 14 is of stainless steel and defines a containment/handling chamber 16 (hereinafter also simply referred to as "the handling chamber 16") which, in use, contains a radioactive material which is to be handled or serviced in the assembly 10. The inner cell 14 is provided with a polycarbonate window 22, which constitutes an upper, diagonally oriented wall of the inner cell 14.

Figure 5:
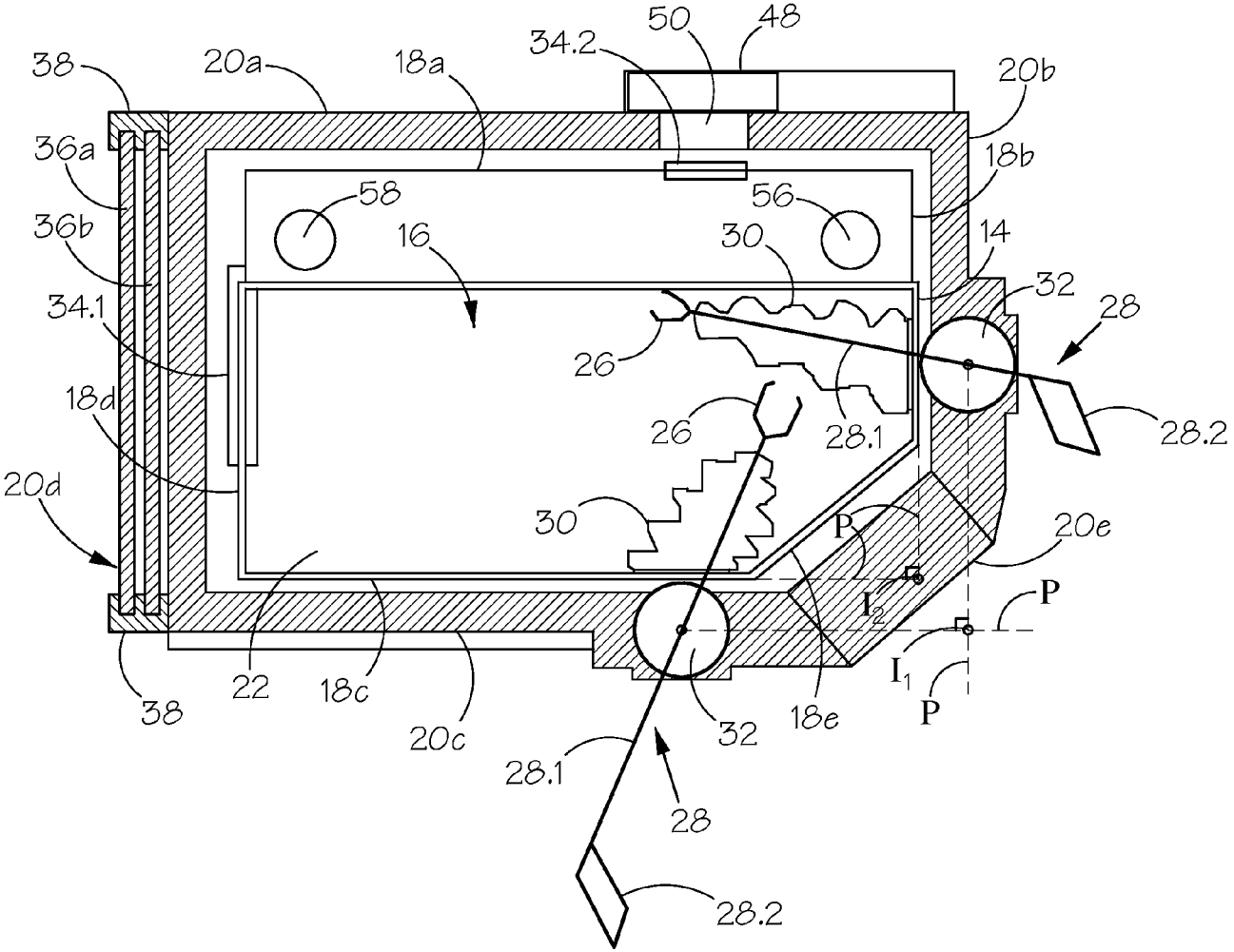
FIG. 5 shows a horizontal section of the handling assembly of FIGS. 1 to 4.
Figure 6:
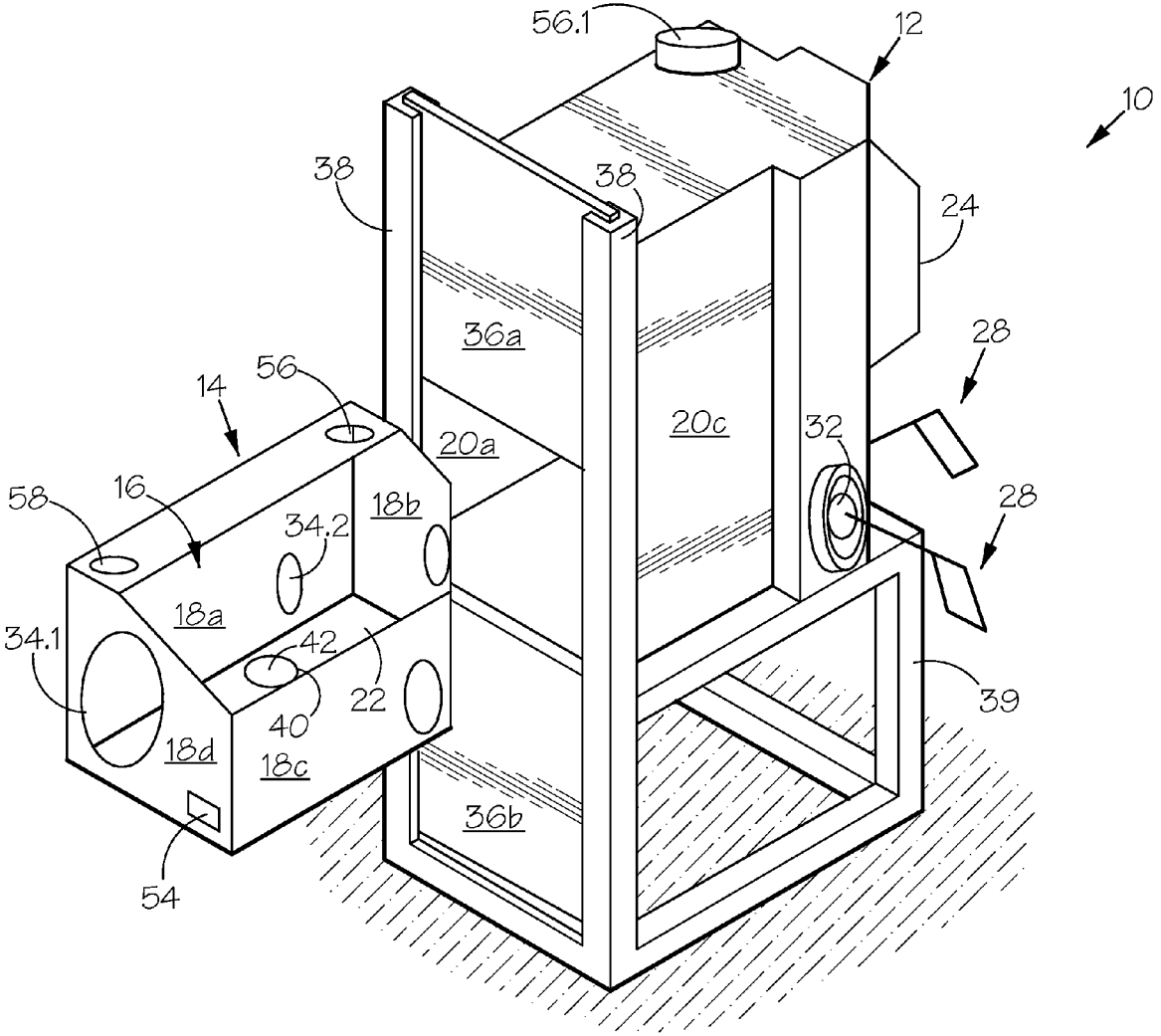
FIG. 6 shows a disassembled perspective view of the handling assembly of FIGS. 1 to 5.

As illustrated most clearly in FIG. 5, the inner cell and outer housing have complementary shapes in horizontal section. More particularly, the inner cell 14 and outer housing 12 have, respectively, two sidewalls, respectively 18*a*, 18*c* and 20*a*, 20*c*, two endwalls, respectively 18*b*, 18*d* and 20*b*, 20*d* and one oblique wall, respectively 18*e* and 20*e*. When the inner cell 14 is mounted in the outer housing the sidewalls 18*a*, 20*a* and 18*c*, 20*c*, the end walls 18*b*, 20*b* and 18*d*, 20*d*, and the oblique walls 18*e*, 20*e* are thus in positions adjacent each other.

The sidewalls 20*a* and 20*c*, the endwalls 20*b* and 20*d* and the oblique wall 20*e* of the outer chamber 12 are of lead, typically being made up of interlocking lead bricks or solid lead slabs which are supported by a high integrity support frame. The outer chamber 12 also has a lead floor and a lead roof.

A window 24 is provided in the oblique sidewall 20*e* of the outer housing 12, the window having a radiation shielding power equivalent to 100 mm lead and providing a line of sight into the handling chamber 16 through the inner cell window 22.

Handling means in the form of tongs 26 are connected to the walls 18*b*, 18*c* of the inner cell 14 by means of flexible boots 30. Complementary control means 28, each comprising a control rod 28.1 and a pistol grip user interface 28.2, are connected to walls 20*b*, 20*c* of the outer housing 12 by lead ball-sockets 32 which render the control means 28 pivotally and axially (slidably) displaceable in the walls 20*b*, 20*c*. The tongs 26 of the wall 18*b* are at a different level to the tongs 26 of the wall 18*c*.

The rods 28.1 of the control means 28 are operatively removably connected to their associated tongs 26 such that a clamping action of the tongs 26 is controlled by operation of the pistol grips 28.2 and such that displacement of the tongs 26 is directed by pivotal and sliding displacement of the rods 28.1 in the sockets 32.

The tongs 26 and their associated control means 28 are positioned respectively in walls 18*b*, 18*c* of the inner cell and adjacent walls 20*b*, 20*c* of the outer housing, which walls 18*b*, 18*c* and 20*b*, 20*c* are rectangularly oriented relative to each other about vertical lines of intersection "I1" and "I2" between projections "P" of the walls 18*b*, 18*c* and 20*b*, 20*c*. The tongs 26 and their associated flexible boots 30 and control means 28 are thus effectively rectangularly, or generally transversely, oriented from each other.

The inner cell 14 is provided with two DPTE ports, comprising a 270-DPTE port 34.1 and a 105-DPTE port 34.2, respectively provided in sidewalls 18*d* and 18*a* of the inner cell 14. The DPTE ports 34.1, 34.2 are respectively aligned with the handling means 26 in the sidewalls 18*b* and 18*c* of the inner cell 14.

The end wall 20*d* of the outer housing 12 is in the form of a sliding door arrangement comprising an upper door panel 36*a* and a lower door panel 36*b* which are slidably mounted parallel in tracks 38 which form part of a high integrity support frame 39 on which the outer housing 12 is supported. The door panels 36*a*, 36*b* are controlled by a pair of connecting cables running on pulleys (not illustrated) such that each panel 36*a* and 36*b* forms a counterweight for the other and such that the panels 36*a*, 36*b* can be easily slidingly displaced towards or away from each other, thereby selectively to allow access to an interior of the outer housing 12.

The inner cell 14 includes a bottom loader port 40 which is closed off by a lid 42, the lid 42 being openable only from inside the handling chamber 16. The port 40 is configured to receive or dock therein a radioactive material container, typically in the form of a pot 45, for loading radioactive and other materials into and out of the chamber 16.

The outer housing 12 is provided with bottom loader port access means 41 (FIG. 7) through which access to the port 40 of the inner cell 14 is enabled from outside the outer housing 12 when the inner cell 14 is mounted inside the outer housing 12. The port access means 41 is in the form of an opening in the lead floor of the outer housing 12, this opening being closed off by a removable lead shielding cover or slot, hereinafter referred to as a key 43, which, when covering the opening, is connected to the lid 42 of the bottom loader port 40 by means of a bayonet fitting 43.1, thereby to lock the lid 42 in place when connected thereto and to prevent opening of the lid 42. Thus, the key 43 locks the lid 42 in the normal closed state of the port 40. The key 43 is operable by a handle 46.5. A portion 43.2 of the key 43 is lead and thus provides radiation shielding to the bottom loader port 40 and the bottom loader port access means 41 when engaged with the lid 42.

The outer housing 12 is further provided with a container loading assembly 46, the assembly 46 including a trolley 46.2, which is supported on a horizontal rail track 46.3 which is connected to the outer housing 12. The trolley 46.2 is provided with container displacement means 46.1, mounted on one end of the trolley 46.2, and with a bottom loading port key receptacle 46.4 on the other end of the trolley 46.2. The end of the trolley 46.2 to which the key receptacle 46.4 is mounted is provided with a lead ring 46.6 (only a section being visible) which provides further radiation shielding when the key 43 is disengaged from the lid 42. The displacement means 46.1 includes a hoist mechanism 44 comprising a carriage 44.4 which is connected to sleeves 44.3 which are slidably mounted on vertical pillars 44.1 on the displacement means 46.1. In use, the pot 45 is supported on the carriage 44.4, which is vertically displaceable in axial alignment with the port 40 of the inner cell 14 through the port access means 41, by means of a pair of connecting cables (not shown) running on pulleys 44.2.

Figure 7:
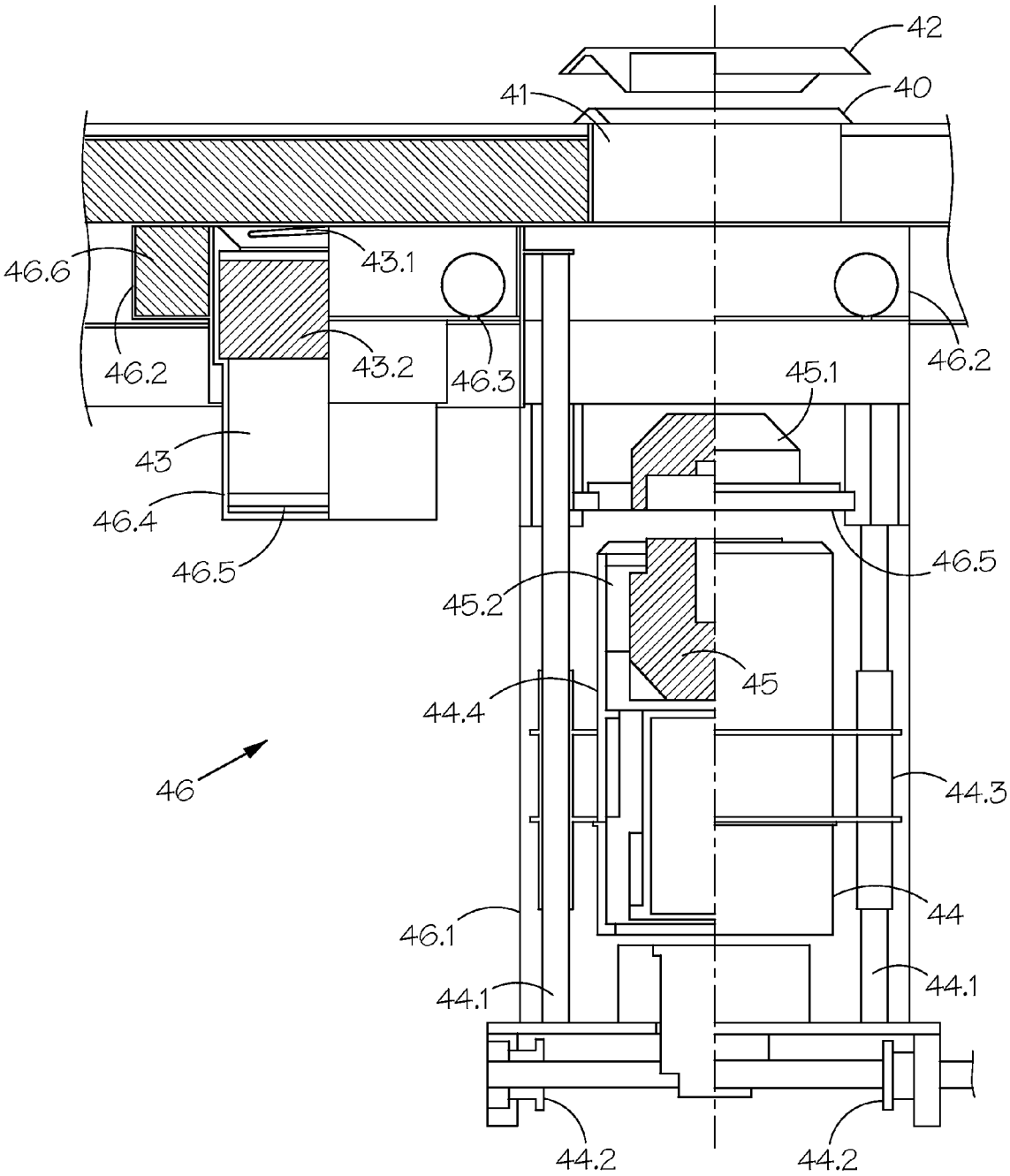
FIG. 7 shows a partial cutaway side view of a container loading assembly of the handling assembly of FIGS. 1 to 6 and indicates portions of radiation shielding material in shading.

In a normal closed or locked position (not shown), the key 43 engages a bayonet fitting (not shown) provided on the lid 42 by means of a complementary bayonet fitting 43.1. In the closed or locked position, the key 43 extends partially into the recess defined by the receptacle 46.4, such that horizontal movement of the trolley 46.2 with its pot 45 and displacement means 46.1 is prevented when the key 43 is engaged with the lid 42, the trolley 46.2 thus effectively being locked in position. Thus, the trolley 46.2 can only move the pot 45 into position in axial alignment with the port 40 when the key 43 has been unlocked by removing it, i.e. unscrewing it, from the lid 42 and stowing it in the receptacle 46.4 on the trolley 46.2 as shown in FIG. 7. After the key 43 has been so stored, the trolley 46.2 is slid laterally, thereby to bring the pot 45 into axial alignment with the port 40.

The loading assembly 46 is further provided with a laterally, or horizontally, sliding plate 46.5, which is operable to remove a lid 45.1 of the pot 45. In use, the hoist mechanism 44 is hoists the pot 45 with its lid 45.1 of similar radiation opaque or shielding material still in a closed condition, towards the port 40. When the lid 45.1 is positioned at the height of the horizontal sliding plate 46.5, which is mounted transversely on the trolley, the lid 45.1 is clamped by a clamping mechanism (not shown) of the sliding plate 46.5 and removed from the pot 45 so that the pot 45 is opened. The open pot 45 is then further raised to its docking position against the port 40. A docking position of the pot 45 is typically at a height where an upper surface of the pot 45 is substantially flush or slightly raised above a rim of the bottom loading port 40 on an inside of the chamber 16. Preferably, the lid 42 is only opened from the inside of the cell 14 when the pot 45 is in this position, thereby to provide access to a radiation source or sample material inside the pot 45. In this configuration radiation leakage from any source or other radioactive material inside the pot 45 is avoided as well as any accidental spillage of materials or dropping of contaminated equipment from inside the handling chamber 16 through the port 40.

The loading assembly 46 is further configured to dock pots of different diameter to the port 40. For each pot 45 of a diameter smaller than the maximum allowable diameter a matching outer spacer ring or sleeve 45.2 is provided, preferably made of similar radiation opaque material and with an outer diameter and shape to match that of the carriage 44.4 as well as that of the port opening 40. Thus, the spacer 45.2 fits snugly around the pot 45 such that, when the lid 45.1 has been removed, the pot 45 and spacer 45.2 invariably docks radiation leak free to the port 40 of the inner cell 14.

It will be appreciated that in use, after the radioactive source or sample has been transported out of or back into the pot 45, the port 40 will be closed with the lid 42 from inside the cell 14, the pot 45 will be lowered, closed with its own lid 45.1 and removed from the loading port 40 and access means 41 in the reverse order of steps indicated hereinbefore for the loading operation. The key 43 will then be replaced and re-engaged with the lid 42 to restore the normal state of integrity as soon as possible.

The outer housing 12 is further provided with access means to the 105-DPTE port 34.2 in the form of lead roller door 48 which closes an access opening 50 in the sidewall **20*a* of the outer housing 12 in a location corresponding to the location of the 105-DPTE port 34.2 in the sidewall 18*a*** of the inner cell.

A chamber 52 is provided as part of the outer housing 12, the chamber 52 being provided with radiation monitoring and detection equipment (not visible) for monitoring radiation emission from the assembly 10. In a preferred embodiment the radiation detection equipment may be a so called ionization chamber, which detects any ionizing radiation. It will be appreciated that, in such an embodiment, the chamber 52 may be the ionization chamber itself. The assembly is also provided with warning means in the form of an alarm (not illustrated) which is associated with the radiation monitoring and detection means in the chamber 52 and is configured to indicate unacceptable radiation emission levels from the assembly 10.

The inner cell 14 is provided with service connection means 54 on the endwall **18*d* thereof, to which service connection means and external service conveying means for conveying services such as electricity, gas, vacuum, water and compressed air to the inner cells are connectable. The connection means 54** preferably includes a connection port for a conveying means for each of these services.

The inner cell 14 is provided with a ventilation inlet 56 to the chamber 16 and an exhaust outlet 58 from the chamber. For each of the inlet 56 and outlet 58 a filter arrangement is provided (not shown) comprising two filter elements each, one inside the cell 14 and the other outside the cell 14, but still within the outer housing 20 and in flow communication with the inner filter element. Service and replacement of the inner filter element in each filter arrangement can be effected from inside the chamber 16 by means of the handling means 28, i.e. without compromising chamber integrity.

The filter arrangement on the ventilation inlet 56 of the inner cell 14 has a corresponding service access means in the form of an opening in the outer housing 20, the opening being shielded by a lead plug or stopper 56.1. The stopper 56.1 is removable to allow replacement of the outer inlet filter element through the service access means.

The filter arrangement on the exhaust outlet 58 has a similar service access means in the outer housing 20, for replacing an outer exhaust filter element, shielded by a lead plug or stopper 58.1. The outer exhaust filter element of the exhaust outlet 58 is connected by means of an exhaust line to a ventilation system of a laboratory or similar site where the handling assembly 10 is accommodated. The exhaust line is guided radiation leak free through the plug 58.1 through a labyrinth channel in the plug 58.1.

In use, with a view to handling radioactive material of a specific type and for a specific purpose, the inner cell 14 is inserted into the outer housing 12 through the sliding door arrangement 36 in a loaded condition, i.e. either pre-loaded with the particular radioactive material or with the remains of a previous operation with the same radioactive material. Alternatively, the inner cell 14 is inserted into the outer housing 12 in an empty condition and the radioactive material is loaded into the handling chamber 16 thereafter through the bottom loader port 40. Other non-radioactive sample materials and equipment are typically loaded through the DPTE ports 34.1, 34.2. When the inner cell 14 has been inserted into the outer housing 12, the control means 28 are connected to their associated handling means 26 and handling of the radioactive material is carried out by operation of the handling means 26 as controlled by the control means 28.

After completion, radioactive materials as well as other waste materials are unloaded from the handling chamber 16 through the bottom loader port 40 and/or the DPTE ports 34.1, 34.2. The inner cell 14 is subsequently sealed and removed from the outer housing 12.

The present invention seeks to provide a multipurpose radioactive material handling or containment assembly (or hot cell) having an increased versatility of use as compared to conventional containment installations, particularly in terms of shortened decontamination times and time required for conducting operations on different radioactive materials therein, including the down time between successive operations. It is thus regarded as an advantage of the invention as described that the use of separate inner cells for each radioactive material which is handled in the assembly obviates, or significantly reduces, the requirement of decontamination of the assembly before a different radioactive material is handled therein, thus enabling a range of operations to be conducted without extended decontamination operations delaying the sequential conducting of such operations and without fear of cross-contamination between successive operations.

The angularly spaced positioning of handling means 26 and associated control means 28 in contrast to a co-planar arrangement, as is typically used in the art of the invention, as well as the provision of the window 24 in the obliquely oriented wall 20*e* in the outer housing, as hereinbefore described, facilitates carrying out operations inside the handling chamber 16 with increased versatility. More particularly, the angular positioning of the handling means and associated control means, and their location at different levels, has the effect that operating ranges of the handling means inside the handling chamber overlap and that no so-called "dead space" below or above the complementary handling and associated control means or in corners of the cell exists as is commonly experienced in conventional handling facilities of which the Applicant is aware. Further, the oblique positioning of the outer housing window in combination with the inner cell window provides greater visibility into all the areas of the inner cell affording a compact handling assembly with optimal space utilisation of the inner cell.

Apart from the bottom loading port, access to and from the outer housing, even when the inner cell is mounted therein, is conveniently facilitated by the sliding doors 36*a*, 36*b* comprising the endwall 20*b* of the outer assembly, as well as by the roller door 48 which provides access to the 105-DPTE door 34.2 of the inner cell when it is mounted inside the outer housing.

Furthermore, a significant advantage of the sliding doors 36*a*, 36*b* is afforded in terms of ease of interchanging inner cells through this door assembly. Such interchange of inner cells can be performed by merely removing the control means 28 and the outer filter elements on top of the inner cell 14 as described hereinbefore, followed by loosening the mountings on the assembly frame. In contrast, in conventional installations known to the Applicant, removal of an inner compartment or chamber, if any, requires at least the partial disassembly of the shielding walls and roof even in the so-called modular arrangements found in the prior art.

It is regarded as an advantage of the invention that, when a range of operations or routine tests on different radioactive materials are being conducted, the use of only one assembly is required due to the interchangeability of the inner cells of the assembly. Conventionally, in order to conduct operations on different radioactive materials, a plurality of conventional containment installations is required: one for each radioactive material or group of compatible materials and with the inevitable duplication of at least most of the handling equipment. The assembly of the present invention is thus compact in the sense that space is saved in a laboratory, or any other location in which it is provided, by the use of only one assembly and a single compact storage space for the different inner cells, which typically only requires shielding of the equivalent of not more than 10 mm lead and no ventilation during storage.

A further advantage of the invention as described is that high containment integrity is maintained by the assembly, despite the continuous interchange of inner cells. This is possible due to the configuration of the bottom loading port of the inner cell and the associated container displacement means of the outer housing, which enables safe and contained loading of radioactive materials into and out of the inner cell when mounted in the outer housing. The configuration of the ventilation inlets and exhausts, as described, also contributes to maintaining high containment integrity. A significant consequential advantage of this high containment integrity combined with the interchangeability of the inner cells is that cross-contamination is avoided between successive operations with different radioactive materials.

It is yet a further advantage of the invention as described that inner cells can be re-used for handling the same radioactive material and do not need to be discarded. This also reduces the production of radioactive waste resulting from decontamination.

Yet a further advantage of the invention is that each inner cell is provided with its own handling means therein. This enables selective handling and other services to be provided in each cell according to requirements of service to be carried out in that cell. This use of separate handling means and other service means in each inner cell further reduces the decontamination requirement of the assembly.

Another advantage of the invention is that, should decontamination of an inner cell be required, such decontamination can be carried out by substituting the flexible attachment means (or boots) for gloves and also installing gloves in the DPTE ports, thereby enabling manual decontamination to be carried out.

Yet another advantage of the invention is that the radioactive material container displacement means of the loading assembly is configured to handle containers or pots always in an upright condition, thereby further reducing the risk of radiation exposure.

The assembly is further adaptable in the sense that further shielding means, such as Perspex™ or polycarbonate screens, may be provided at sections with minimal shielding, thereby to provide further protection against radiation exposure.

To demonstrate some of these advantages, the Applicant established, on a prototype handling assembly or facility according to the invention, that the inner cells can typically be interchanged by one or two persons in less than four hours. This includes detaching all the handling means and other external devices and service connections from the removed inner cell and reattaching the same after the replacement inner cell has been inserted and fitted, but excludes the required containment checks such as measuring radiation levels around the inner cell and taking sample smears for possible contamination on the outside of the inner cell as it is being removed from the outer housing. It also includes the removal of certain sections of lead shielding from the outer housing such as the ventilation port stoppers 56.1 and 58.1 to disconnect and remove the outer filter elements from the inlet and outlet ventilation lines respectively. This amounts to less than about 3% of the total mass of lead used in the outer housing shielding of the prototype handling facility.

In contrast, in order to prepare a conventional handling facility, which does not feature the interchangeable inner cells of the present invention, to handle a different radioactive species, including the actions required to decontaminate and prepare the facility for the next species in accordance with the standards commonly known in the art, will typically take at least one week, and in some cases up to several months, depending on the extent to which the contaminating species have penetrated and/or are attached to the inner walls of the facility.

The Applicant has also found that a typical inner cell storage space with a capacity of at least six inner cells and provided with the said shielding of not more than 10 mm lead will take up a floor space about equal to that of the handling assembly itself.

The invention claimed is:

1. A radioactive material handling assembly, which includes an outer housing;

an inner cell which defines a radioactive material containment/handling chamber and which is individually removably mountable inside the outer housing, the inner cell being complementary in shape to the outer housing when both are seen in horizontal section such that, when the inner cell is mounted inside the outer housing, a plurality of walls of the inner cell are adjacent corresponding walls of the outer housing, the inner cell being interchangeable with a plurality of other inner cells which are individually removably mountable inside the outer housing, with at least one of the outer housing and the inner cell being predominantly of a shielding material which is opaque to radioactivity; and at least two handling units configured to operate from outside the inner cell to handle radioactive materials located in the containment/handling chamber, the at least two handling units being mounted to respective walls of the inner cell, which walls are angularly spaced relative to each other about a vertical line of intersection between the walls or projections thereof such that the handling units are thus also angularly spaced from each other, when the inner cell is seen in plan view.

2. An assembly according to claim 1, wherein the handling unit comprises a manipulating portion inside the containment/handling chamber, and an attachment portion connecting the manipulating portion to a wall of the inner cell, the attachment portion configured to enable movement of the manipulating portion.

3. An assembly according to claim 2, which includes a controller configured to operate the handling unit, the controller, in use, being operable to control operation of the handling unit from a position remote from the containment/handling chamber.

4. An assembly according to claim 3, wherein the controller comprises a control rod, one end portion of the control rod being connected to the handling unit and an opposite end portion of the control rod extending beyond the confines of the outer housing and being provided with a user control interface.

5. An assembly according to claim 4, wherein the control rod is pivotally mounted in a wall of the outer housing, thereby to direct pivotal movement of the handling unit.

6. An assembly according to claim 1, wherein the angularly spaced walls are at an angular spacing of 90° to each other.

7. An assembly according to claim 1, which includes a viewing access configured for visual inspection of radioactive materials contained in and being handled inside the containment/handling chamber when the inner cell is mounted inside the outer housing.

8. An assembly according to claim 7, wherein the viewing access is in the form of at least one window in a wall of each of the inner cell and the outer housing, the windows providing a line of sight from a position external to the assembly, to the containment/handling chamber when the inner cell is mounted inside the outer housing.

9. An assembly according to claim 8, wherein at least one of the windows is of radiation opaque material having a radiation shielding power equivalent to at least 75 mm lead.

10. An assembly according to claim 8, wherein at least one of the windows is provided in a connecting wall which connects the angularly spaced walls in which the two handling units are, respectively, provided.

11. An assembly according to claim 10, wherein the connecting wall is obliquely oriented relative to the angularly spaced walls.

12. An assembly according to claim 1, wherein the handling units are positioned at different levels in the inner cell and outer housing, the handling units thus being vertically spaced from each other.

13. An assembly according to claim 1, wherein the inner cell is provided with containment/handling chamber access configured for introducing materials into, and withdrawing materials out of, the containment/handling chamber.

14. An assembly according to claim 13, wherein the containment/handling chamber access comprises an inner and an outer door assembly such that the integrity of the containment/handling chamber is not compromised during the introduction of materials into, or withdrawal of materials out of, the containment/handling chamber.

15. An assembly according to claim 1, wherein the inner cell is provided with a bottom loading port configured for loading materials into and out of the containment/handling chamber through the bottom of the cell, and a closing mechanism which closes and seals the bottom loading port from the inside of the containment/handling chamber.

16. An assembly according to claim 15, wherein the outer housing is provided with a bottom loading port access associated with and providing access to the bottom loading port of the inner cell from outside the assembly, when the inner cell is mounted in the outer housing.

17. An assembly according to claim 16 which includes, on the outer housing, a container loading assembly comprising a container displacement unit configured to dock containers against the bottom loading port through the bottom loading port access.

18. An assembly according to claim 17, wherein the loading assembly includes a hoist configured to hoist a container towards the bottom loading port.

19. An assembly according to claim 18, wherein the loading assembly is configured to dock containers of different diameter to the bottom loading port by having mounted to the hoist, for each container of a particular diameter, a matching outer spacer ring or sleeve configured to receive the container, with the outer spacer ring or sleeve having a fixed outer diameter and shaped to match a carriage of the hoist as well as the bottom loading port opening.

20. An assembly according to claim 1, wherein the inner cell is provided with at least one ventilation inlet to the containment/handling chamber and at least one exhaust outlet from the containment/handling chamber, with the ventilation inlet and outlet exhaust being provided, respectively, with inlet and outlet filters.

21. A method of operating a radioactive material handling assembly having an outer housing, to handle radioactive materials therein, the method including inserting, individually, an initial or first inner cell into the outer housing of the assembly such that the initial or first inner cell is individually mounted inside the outer housing with a plurality of walls thereof being adjacent corresponding walls of the outer housing;

handling an initial or first radioactive material inside a containment/handling chamber of the initial or first inner cell from a position outside the outer housing;

removing the initial or first inner cell from the outer housing; and inserting a second inner cell into the outer housing after removal of the initial or first inner cell from the outer housing and handling a second radioactive material inside a containment/handling chamber of the second inner cell, the second radioactive material being different from the initial or first radioactive material.

22. A radioactive material handling assembly comprising:

an outer housing defined by outer housing walls including at least a first outer housing wall and a second outer housing wall that is angularly displaced from the first outer housing wall;

an inner cell having a shape complementary to the outer housing and defined by inner cell walls including at least a first inner cell wall and a second inner cell wall that is angularly displaced from the first inner cell wall, the inner cell removably mountable inside the outer housing where, upon mounting, the first inner cell wall is adjacent the first outer housing wall and the second inner cell wall is adjacent the second outer housing wall;

a first handling unit disposed at the first outer housing wall; and a second handling unit disposed at the second outer housing wall such that the second handling unit is angularly displaced from the first handling unit;

wherein the first and second handling units extend from the exterior of the outer housing to the interior of the inner cell and are configured to handle radioactive materials located in the inner cell.

23. An assembly according to claim 22, wherein the outer housing walls further include a third outer housing wall and a fourth outer housing wall, wherein the inner cells walls further include a third inner cell wall and a fourth inner cell wall, and wherein, upon mounting, the third inner cell wall is adjacent the third outer housing wall and the fourth inner cell wall is adjacent the fourth outer housing wall.

* * * * *